US005538250A

United States Patent [19]

Putz

[11] Patent Number: 5,538,250

[45] Date of Patent: Jul. 23, 1996

[54] GOLF BALL SIGHTING DEVICE AND METHOD THEREFORE

[76] Inventor: Lawrence J. Putz, 2120 Barberry Ave., Grand Junction, Colo. 81506

[21] Appl. No.: 383,791

[22] Filed: Feb. 6, 1995

[51] Int. Cl.[6] ..... A63B 69/36

[52] U.S. Cl. ..... 473/210; 473/268; 473/409

[58] Field of Search ..... 273/187.6, 190 R, 273/190 A, 187.2, DIG. 17; 351/155; 33/262; 434/252

[56] References Cited

U.S. PATENT DOCUMENTS

| | | | |
|---|---|---|---|
| 2,663,021 | 12/1953 | Douglass | 273/190 A |
| 3,268,228 | 8/1966 | Novack | 273/190 A |
| 3,437,339 | 4/1969 | Starck | 273/190 A |
| 3,826,502 | 2/1974 | Sorge | 273/187.6 |
| 3,861,688 | 1/1975 | Butler . | |
| 3,915,457 | 10/1975 | Casey . | |
| 3,951,414 | 4/1976 | Nunez | 273/187.6 |
| 4,063,740 | 12/1977 | Mader | 273/187.6 |
| 4,303,244 | 12/1981 | Uppvall . | |
| 4,502,035 | 2/1985 | Obenauf et al. . | |
| 4,598,911 | 7/1986 | Lepera . | |
| 4,762,325 | 8/1988 | McCleery | 273/187.6 |
| 4,911,450 | 3/1990 | Rabold . | |
| 4,998,731 | 3/1991 | Bowen . | |

OTHER PUBLICATIONS

HeadFreezer by Ray McCleery, *GOLF DIGEST*, Feb. 1995.

*Primary Examiner*—Steven B. Wong

*Attorney, Agent, or Firm*—Timothy J. Martin; Michael R. Henson

[57] ABSTRACT

A golf ball sighting device for use as a teaching aid by encouraging a golfer to keep his head stationary while executing a golf swing comprising a sighting element having a viewing portion therein which is sized and configured to allow a golf ball to be viewed therethrough and a mounting member disposed on the sighting element to interconnect the sighting element to an item worn by the golfer.

24 Claims, 4 Drawing Sheets

GOLF BALL SIGHTING DEVICE AND METHOD THEREFORE

FIELD OF INVENTION

The present invention generally relates to a golf ball training device which can be used either on the practice range or during actual play. The present invention is specifically directed to a golf ball sighting device which can be used as a teaching aid by encouraging a golfer to keep his/her head stationary while executing a golf swing.

BACKGROUND OF THE INVENTION

For years the game of golf has enjoyed wide popularity as a favorite pastime for avid enthusiasts and beginners alike. One reason for this overwhelming popularity is that golf allows participants of all ages and skill levels to play the game as a social activity or a competitive sport, without diminishing the enjoyment for the individual participants.

The characteristics of golf are well known. The game is played on a golf course which, typically, has eighteen (18) holes. Each hole has its own distinctly contoured features and is designated as a par three, four or five. Each hole has a target pin located on a green which is a selected distance away from a fairway tee box. This distance can range from as little as about 100 yards to a distance in excess of 600 yards. The object of the game is to hit a golf ball from the fairway tee box to the green and into a cup positioned at the base of the target pin in as few strokes as possible. Accomplishing this task, however, can be quite challenging. A golfer has at his disposal a selected number of golf clubs, usually fourteen (14), with which he/she hits the ball in the direction of the target pin. Each golf club has its own characteristics and features which determine, generally, how far the golf ball will travel once it is hit and the trajectory that the ball will take during flight. Accordingly, many factors come into play which determine how well a golfer is able to play the game—contour of the particular hole, weather conditions and club selection to name a few. Without a doubt, the most important factor is the individual player's own ability.

As is true with most sports, golf is best learned through practice. Accordingly, most golf courses provide a driving range facility so that players may practice their golf swing either prior to or after playing. These driving ranges usually have several target pins positioned at various distances from the simulated tee box. The player can then practice a golf swing at his/her own pace with range balls which do not have to be retrieved once they are hit at the targets. Golfing lessons are also available to help players improve their game. The difficulty with either going to a driving range or taking private lessons is that this can be time consuming, inconvenient and expensive. Therefore, is it desirable to provide golf teaching devices which are both portable and inexpensive.

To address this need, numerous products have infiltrated the market in an effort to teach golfers the mechanics of a proper golf swing. One example of a personal use golf practice device is shown in U.S. Pat. No. 4,095,798 issued Jun. 20, 1978 to Marpel. In this practice device, a golf ball is mounted to the proximal end of a cord whose distal end is connected to a rubber strap. The rubber strap is, itself, tethered to a cork-screw stake which is screwed into the ground. Design U.S. Pat. No. D319,092 issued Aug. 13, 1991 to Dennesen discloses a golf ball which is attached to a swing apparatus; when hit, the golf ball swings around the stake. Other improvements on this concept have resulted in devices which are now able to calculate the golf ball's travel distance and display this distance in yards for every swing. A sophisticated computer is able to deduct yardage based on the degree of resulting hook or slice.

Another example of a golf swing practice device involves a structure formed as concentric plastic rings which rest on the ground at an incline. The golfer practices his swing by standing in the center of the structure and placing the golf club within the area between the concentric circles. When executing the golf swing, then, the device reduces errors in swing mechanics by limiting the area within which the club may travel.

Other products address the importance of ensuring that the golfer knows how to properly hold the golf club while swinging. One such product is an injection molded grip which is made to accommodate a golfer's hands only when they are properly placed on the shaft of the club. While the grip is advantageous because it teaches one of the basic mechanics of a golf swing and can be used on the golf course, the golfer must purchase a grip for every club to enjoy any real benefit; thus, this product is used more often on the practice range.

While many of these inventions have their own advantages, such as portability, convenience and home-use, they are limited in their practical applications. With the exception of the grip discussed above, none of these products are able to be used by the golfer during real time play on the golf course. Moreover, these devices can be quite expensive and none of them particularly address the need for the golfer to master one of the basic, often overlooked, mechanics of a proper golf swing—the need for the golfer to keep his/her eyes on the ball and his/her head stationary throughout the swing. These devices, rather, teach other swing characteristics without recognizing the importance of this aspect of the swing.

Accordingly, there remains a need for an improved golf training device which can be used either on the practice range or during actual play. There is a further need for such a device to be lightweight, portable, and of small size so as not to encumber or distract the golfer while he is playing. The present invention, is directed to meet these needs.

SUMMARY OF INVENTION

An object of the present invention is to provide a new and useful golf teaching device which may be readily employed either on a practice range or during actual play on a golf course.

Another object of the present invention is to provide a golf ball sighting device which enables a golfer to confine his/her view to the golf ball while executing a golf swing, and thereby encourage the golfer to keep his/her head stationary throughout the swing.

It is also an object of the present invention to provide a golf ball sighting device which permits a golfer to have an unrestricted view of surrounding areas while executing a golf swing.

A further object of the present invention is to provide a golf ball sighting device as a learning aid which is portable, light-weight, inexpensive, and of a one-piece construction.

Still a further object of the present invention is to provide a golf training device that removably attaches to an item worn by a golfer.

Yet another object of the present invention is to provide an article of apparel to be worn by the golfer during play which enables the golfer to better concentrate on the golf ball while executing a golf swing.

A still further object of the present invention is to provide a new and useful method wherein a golfer is able to have a confined view of the golf ball while executing a golf swing and where such method encourages the golfer to keep his/her head down with the eyes focused on a golf ball while executing a golf swing.

According to the present invention, then, a golf ball sighting device is provided for use as a teaching aid by encouraging the golfer to keep his/her head stationary by executing a golf swing. In use, the golf ball sighting device is attached to an item worn by the golfer and positioned on the line of sight between the golfer and a golf ball while the golfer is in a position to execute the golf swing. A methodology is also provided for interposing the golf ball sighting device between the golfer and the golf ball so as to enable the golfer to have a confined view of the golf ball while executing the swing.

Broadly, the golf ball sighting device comprises a sighting element having a viewing portion therein which is sized and configured to allow the golf ball to be viewed through the sighting element. A mounting member is disposed on the sighting element and is adapted to interconnect the sighting element to an item worn by the golfer. It should be appreciated that this item may include, but is not limited to, hats, visors, eyeglasses, headbands or any other accessories which would enable the golfer to position the sighting element appropriately along the line of sight between the golfer's eyes and the golf ball. The sighting element, then, is positioned between the golfer and the golf ball so that, when the golfer is in a position to execute a golf swing he/she is able to view the golf ball through the viewing portion, thereby enabling the golfer to have both a confined view of the golf ball during execution of the golf swing and an unrestricted view of surrounding areas. It is preferred that the viewing portion of the sighting element is sized and configured to allow the entire golf ball to be seen. It is also preferred that this viewing portion have a dimension which extends a majority of a transverse distance between side edges of the sighting element.

The sighting element may be constructed as a longitudinal strip of material with an aperture formed therethrough. This aperture may take on a variety of different shapes and sizes to accomplish this including, but not limited to, circles, rectangles, or a pair of laterally juxtaposed parallel strips. The presence of a plurality of differently sized apertures also is helpful. The golf ball sighting device would also achieve best results when the sighting element is substantially opaque apart from the aperture(s) formed therein because this will provide a less distracting way for the golfer to view the ball.

It is preferred that the mounting member disposed on the sighting element be formed as a clip structure in order to effectively receive and retain the item worn by the golfer. This clip structure would generally include a pair of cooperating jaws, which operate to open and close to define a channel for receiving the item. Various clip structures could be used to accomplish this, such as a spring-biased alligator clip or clip having a pair of resiliently biased opposed jaws. Mounting members such as VELCRO® or adhesive may also be employed. Regardless of the type of mounting member selected, it should be understood that it could be used with a variety of different sighting elements as discussed above. In one embodiment of the present invention, the sighting element may also be pivotally attached to the mounting member to allow the golfer to reposition the sighting element to a location which is no longer within his/her line of sight.

An article of apparel can also be constructed in accordance with the objects of the present invention which comprises head wear having a brim, such as a hat or a visor, to which is attached any one of the various constructions of the golf ball sighting device discussed above.

The broad methodology of the present invention involves providing a golf ball sighting device which includes a sighting element having at least one aperture formed therethrough and a mounting element connected to the sighting element. Preferably the aperture(s) is sized and configured to allow the golfer to view the entire golf ball. The next step is to attach the mounting member to apparel worn by the golfer so that the sighting element is interposed at a location along the line of sight between the golfer and the golf ball when the golfer is in a position to execute a golf swing, thereby permitting the golfer to have both a confined view of the golf ball and an unrestricted view of surrounding areas.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

The present invention is directed to a golf ball sighting device which can be used as a teaching aid while playing or practicing golf. Specifically, the present invention is directed to a golf ball sighting device which encourages a golfer to keep his/her head stationary while executing a golf swing. The golf ball sighting device is mountable on an item worn by the golfer and broadly comprises a sighting element, which has a viewing portion therethrough, and a mounting member for interconnecting the sighting element to an item such as a cap, visor, headband, glasses, etc., worn by the golfer. The present invention is also directed to a methodology of mounting the golf ball sighting device to the item worn by the golfer In such a way that the sighting element is interposed on a line of sight between the golfer and the golf ball at a location which allows the golf ball to be viewed.

Figure 1:
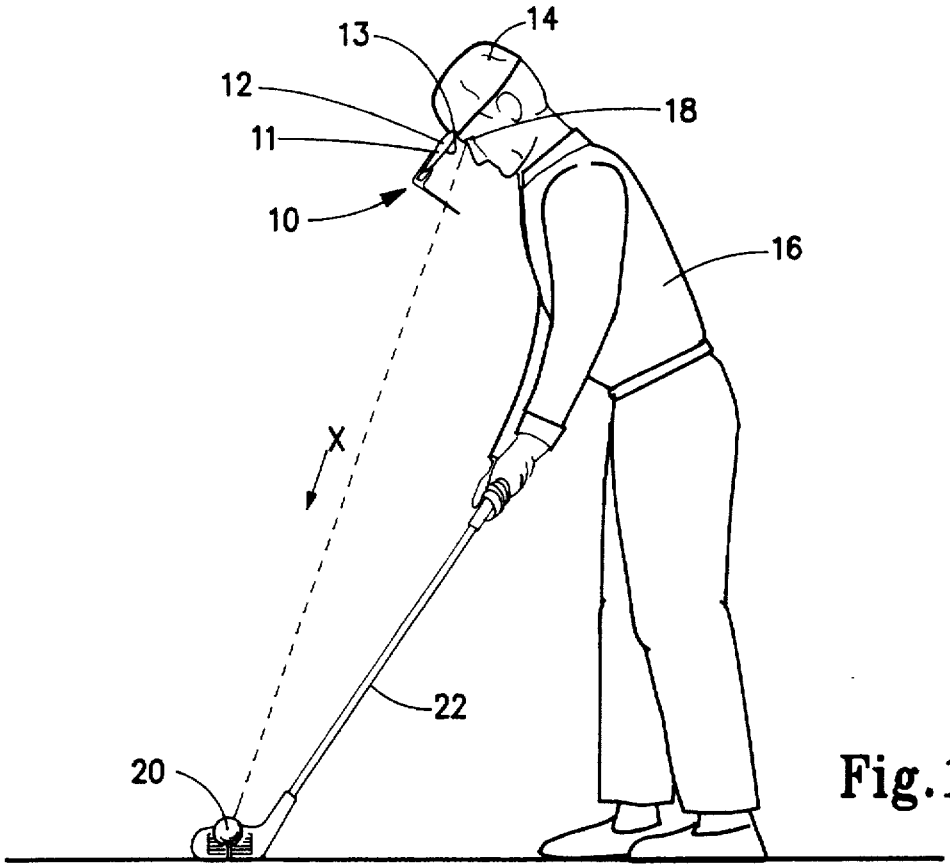
FIG. 1 is a perspective view showing a first exemplary embodiment of the present invention in use by a golfer in a position to execute a golf swing.

With reference to FIG. 1, then, it may be seen that a first exemplary embodiment of the present invention is provided by a golf ball sighting device 10 which is adapted to be mounted onto the brim 12 of a hat 14 worn by golfer 16. When mounted properly, the sighting element 30 of the golf ball sighting device 10 is interposed on an axis or a line of sight "x" between the golfer's eyes 18 and a golf ball 20. Thus, when golfer 16 executes a golf swing with club 22, he/she has a confined view of primarily the golf ball 20 since the ball would be viewed through a viewing portion 52 located on sighting element 30, as described more thoroughly below.

Figure 2:
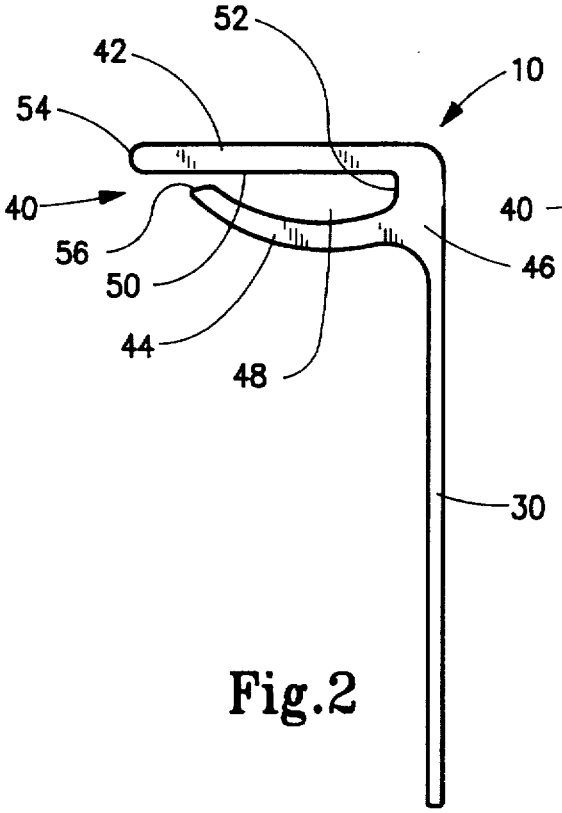
FIG. 2 is a side view in elevation of the golf ball sighting device according to the first exemplary embodiment of the present invention.
Figure 3:
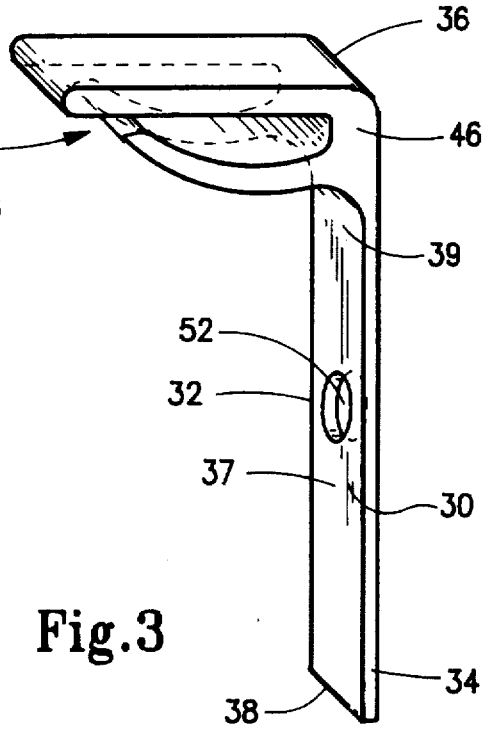
FIG. 3 is a perspective view of the golf ball sighting device shown in FIG. 2.
Figure 4A:
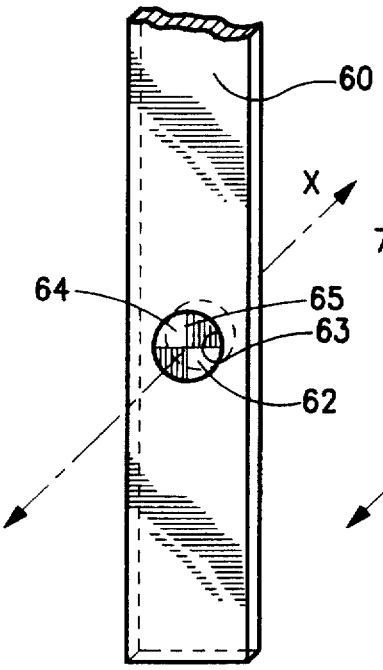
FIGS. 4(*a*)–(*e*) show a variety of constructions for the viewing portion(s) which can be formed within the sighting element which forms a part of the golf ball sighting device of the present invention.
Figure 4B:
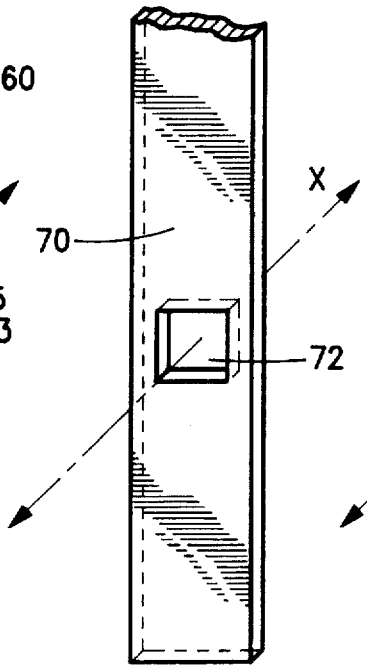
Figure 4C:
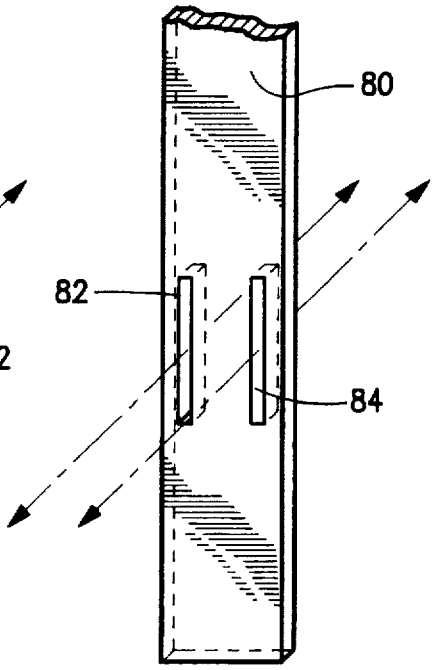
Figure 4D:
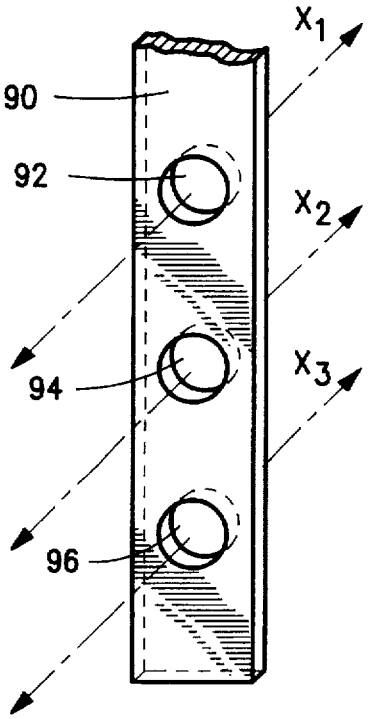
Figure 4E:
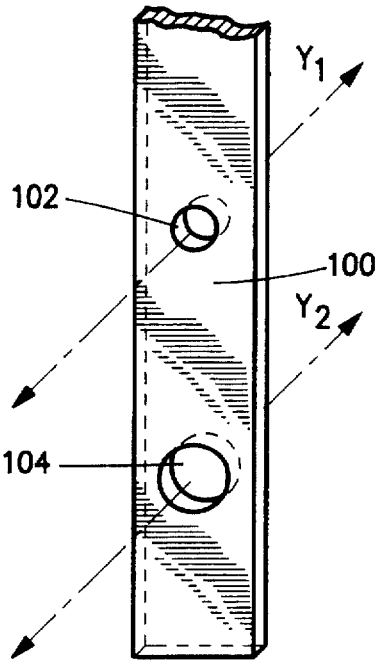

Sighting device 10 is best shown in FIGS. 2 and 3 wherein it may be seen that the sighting device 10 comprises a mounting member 40 and sighting element 30. Mounting member 40 is formed as clip structure having a pair of cooperating jaws, 42 and 44 respectively. First and second jaws 42 and 44 are joined at their respective ends by wall 46 to define a channel 48 located therebetween which is sized and adapted to receive and retain an item worn by golfer 16—in this embodiment the brim 12 of hat 14. First jaw 42 has an inner longitudinal edge 50 which is substantively planar so as to conform to the contour of the flat upper surface 11 of brim 12. Second jaw 44 is an upwardly curved resilient member which provides a clamping action to the clip structure when mounted on brim 12. At this point, it should be understood that the item worn by golfer 16 is not limited to the hat 14 as shown in FIG. 1. Rather, the present invention anticipates that the golf ball sighting device 10 may be used in conjunction with any item of apparel worn by the golfer 16 provided the sighting device 10, and specifically the sighting element 30, is properly positioned between the golfer's eyes 18 and the golf ball 20 to enable the golfer to have a confined view of golf ball 20 while executing the golf swing. This confined view will, thus, encourage the golfer to focus his/her eyes on the golf ball while swinging; this in turn results in the head remaining stationary throughout the swing. It should also be appreciated that sighting element 30 is sized to permit golfer 16 to have an unrestricted view of surrounding areas during execution of the golf swing.

Moreover, while the mounting member 40 of FIGS. 2 and 3 is particularly structured to conform to the brim 12 of hat 14, other constructions are certainly permissible; the important thing is that mounting member 40 be constructed to securely and properly mount the golf ball sighting device 10 to register sighting element 30 in a position which enables the golfer 16 to view golf ball 20 therethrough without risk of displacement during the golf swing.

In the first exemplary embodiment of FIGS. 2 and 3, sighting element 30 is integrally connected to mounting member 40 via wall 46 and sighting element 30 downwardly depends from mounting member 40 when in a mounted state on hat 14. Sighting element 30 is an elongated member and is defined by longitudinal side edges 32 and 34 and terminates at a distal transverse edge 38. Longitudinal side edges 32 and 34 are substantially parallel to each other, as are transverse edges 36 and 38.

With reference to FIG. 3, it may be seen that a viewing portion is formed as a circular aperture 52 in sighting element 30 and extends from front surface 37 completely through viewing element 30 to rear surface 39. As is evident in FIG. 3, this viewing portion preferably has a dimension which extends a majority of a transverse distance between side edges 32 and 34 of sighting element 30. Here, aperture 52 is sized to enable golfer 16 to view golf ball 20 in its entirety when golf ball sighting device 10 is mounted on the brim 12 of hat 14. Sighting element 30 is substantially opaque apart from aperture 52. Preferably, the diameter of aperture 52 is between approximately 0.44 cm (11/64 in) and 0.95 cm (24/64 in). The precise dimension of aperture 52 is necessarily dictated by the height of golfer 16, the distance from which golfer 16 is positioned from golf ball 20 and the size of golf ball 20. In addition, it should be understood that sighting element 30 can be formed in any shape which can spacially accommodate aperture 52.

As shown in FIGS. 4(*a*)–(*e*), sighting element 30 may be formed to have a variety of different viewing portions, any of which may be used in conjunction with the mounting member discussed above. To illustrate some alternative constructions for the sighting element, FIG. 4(*a*) depicts a sighting element 60 having a viewing portion 62 formed therein which is defined by circular opening 63 having a transparent film 64 disposed thereacross. Film 64 is preferably provided with cross hairs 65 to facilitate sighting of the golf ball. Viewing portion 62 preferably has a diameter of between 0.44 cm (11/64 in) and 0.95 cm (24/64 in). As shown in FIG. 4(*b*), sighting element 70 may also have a rectangular aperture 72 formed therethrough. Here, the rectangular aperture may be configured as a square having an area of at least 0.40 $cm^2$ (about 0.063 $in^2$). In FIG. 4(*c*), sighting element 80 has two parallel slits 82 and 84 formed therein. The two parallel slits 82 and 84 are laterally juxtaposed on sighting element 80 and are separated by a distance of approximately 0.6 cm (0.24 in) to 0.7 cm (0.27 in).

As shown in FIGS. 4(*d*) and 4(*e*), the sighting element may also be constructed to have a plurality of apertures formed therein. In FIG. 4(*d*), a sighting element 90 is shown to have three viewing apertures 92, 94 and 96. Apertures 92, 94 and 96 are configured as circular apertures which are equally sized and with adjacent pairs preferably being equidistantly spaced from one another along sighting element 90. Each of these apertures 92, 94 and 96 are sized to allow golfer 16 to selectively view golf ball 20 through any one of these apertures along lines $X_1$, $X_2$ or $X_3$. Thus, this construction recognizes that differently sized golfers will be using the golf ball sighting device 10 and that each golfer has his/her own individual comfort positions when addressing a golf ball. Accordingly, the golfer 16 is able to select which of the three apertures 92, 94 or 96 best suits his/her style of play. FIG. 4(*e*) shows that sighting element 100 can also be constructed to have a plurality of differently sized apertures 102 and 104 formed therethrough. These differently sized apertures are useful where the golfer 16 positions golf ball 20 at varying distances away when addressing the ball. For example, in the situation where a longer club (such as a driver) is needed, the golf ball 20 would most likely be positioned at the furthest position from golfer 16. Thus, golfer 16 could select a small aperture to better enable the golfer to restrict his/her view to golf ball 20. However, for a shorter club selection (such as a wedge), one of the larger apertures would be necessary for golfer 16 to view the entire golf ball, by virtue of the closer proximity of golf ball 20 to the golfer's eyes 18. Thus, it is preferred that viewing portion 102 is sized smaller than viewing portion 104 because when golf ball sighting device 10 is mounted as shown in FIG. 1, a golf ball seen through viewing portion 102 along line of sight $y_1$ would be further away from golfer 16 than a golf ball which may be seen through viewing portion 104 along line of sight $y_2$.

It should be appreciated that FIGS. 4(*a*)–(*e*) are only representative of a few embodiments of sighting element 30 which may be used in accordance with the teachings of the present invention. Numerous sizes and configurations of apertures could be used in constructing the present invention—the only real limitation being that these apertures be sized and configured to allow golf ball 20 to be viewed therethrough, preferably in its entirety, when the golfer is prepared to execute the golf stroke. Regardless of the configuration chosen, it should be understood that the precise dimensions and shape of the aperture are dictated by the height of the golfer, the distance from which the golfer is positioned from the golf ball and the size of the golf ball used. With the exception of FIG. 4(*c*), all of the embodiments depicted show a viewing portion which is defined by at least one aperture having a dimension which is oriented transversely to the line of sight and which extends a majority of a separation distance between the longitudinal side edges of the sighting element.

Figure 5:
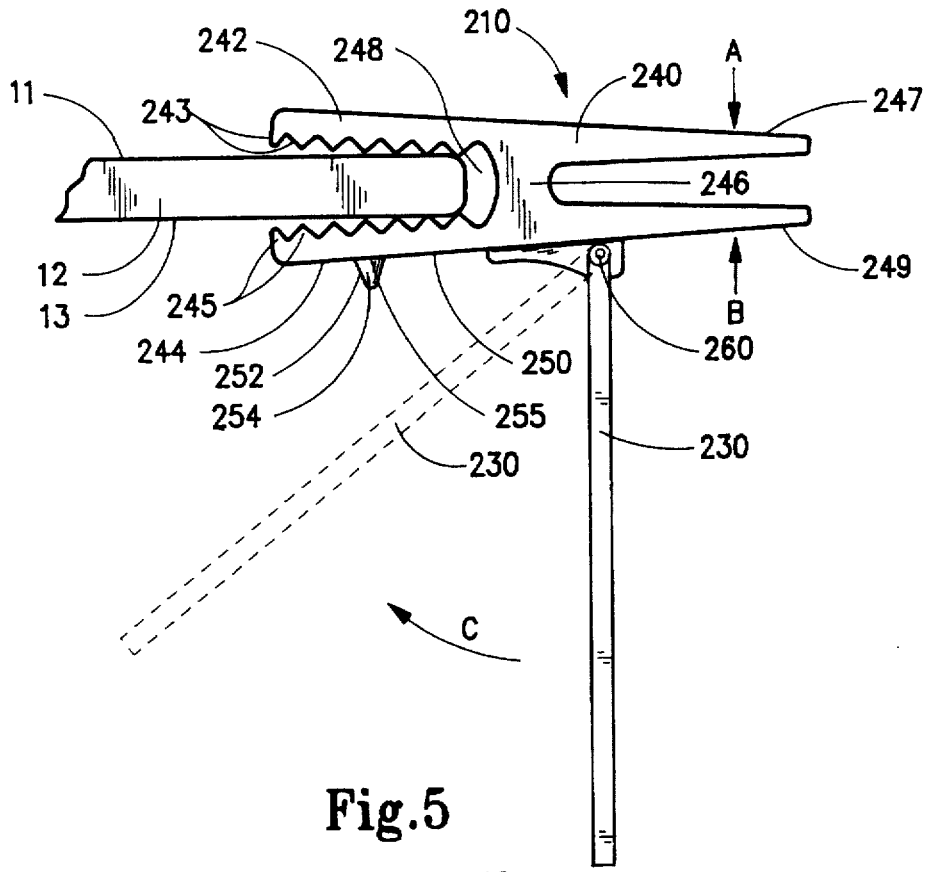
FIG. 5 is a side view of the golf ball sighting device according to the second exemplary embodiment of the present invention, which shows the sighting element to be pivotally attached to the mounting member.

A second exemplary embodiment of the present invention is shown in FIG. 5, where it may be seen that the mounting member 240 of golf ball sighting device 210 is constructed as an alligator clip having an upper jaw 242 and a lower jaw 244. Upper jaw 242 and lower jaw 244 are interconnected near their midpoints by a joining wall 246 to form a mouth 248 therebetween. Upper and lower jaws 242 and 244 have a plurality of teeth, 243 and 245 respectively, formed along their inner surfaces for securely clamping mounting member 240 to the brim 12 of hat 14 or on some other item worn by the golfer. Mounting member 240 is adapted to clamp onto the brim of hat 12 by pressured exerted at ends 247 and 249 of jaws 242 and 244. For example, as pressure is exerted at ends 247 and 249 in the direction of arrows A and B, the mouth 248 of mounting member 240 opens to receive brim 12. As pressure is released, mouth 248 closes due to the spring biasing of mounting member 240 and teeth 243 and 245 clamp onto upper surface 11 and lower surface 13 of brim 12.

FIG. 5 also shows that sighting element 230 may be pivotally connected to mounting member 240 by a pivot pin 260 connected to the bottom 250 of mounting member 240. Pivot pin 260 thereby allows sighting element 230 to be pivoted in the direction of arrow "C" to a location where it is no longer within the line of sight of golfer 16. A retention clasp 252 is formed on the bottom surface 250 of lower jaw 244. Clasp 252 includes a pair of bars 254, 255 which are adapted to engage and releasably secure sighting element 230 to bottom surface 250. The pivoting mechanism could be useful for various reasons. For example, sighting element 230 may be pivoted to a location along the direction of arrow "C" which would give golfer 16 a better view of golf ball 20; or, alternatively, sighting element 230 may be pivoted to a location in which it is substantially parallel to the brim 12 of hat 14 when golfer 16 no longer desires to use the golf ball sighting device 10—such as the situation when golfer 16 is putting instead. It should be appreciated that the sighting element 230 of this second embodiment may be any one of the various constructions discussed above in reference to FIGS. 4(*a*)–4(*e*).

Figure 6:
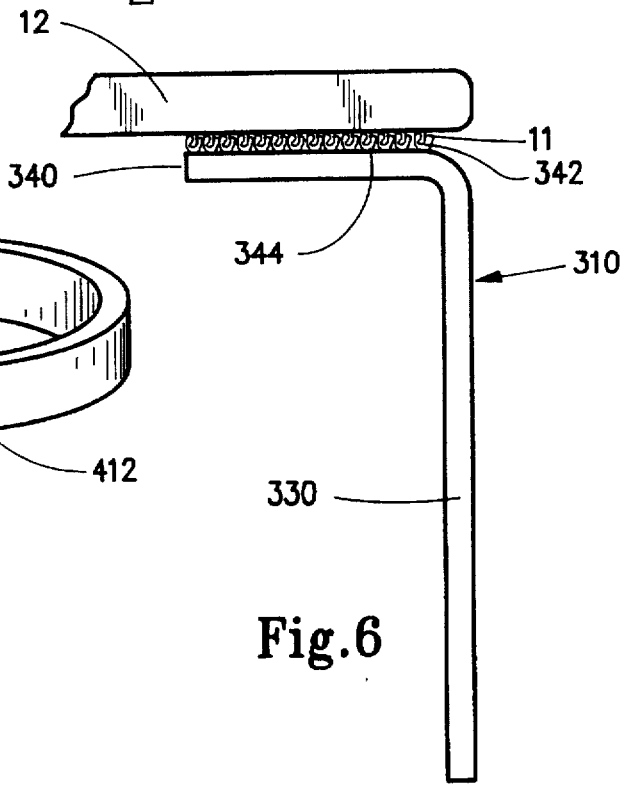
FIG. 6 is a side view in elevation of the golf ball sighting device according to the third exemplary embodiment of the present invention.

A third exemplary embodiment of the present invention is shown in FIG. 6 where mounting member 340 of golf ball sighting device 310 is constructed as a piece of VELCRO® material for a secured attachment to brim 12 of hat 14. Mounting member 342 has a plurality of hooks 342 disposed on its upper surface 344 which allow mounting member 340 to be releasably secured to the lower surface 11 of brim 12. In this third exemplary embodiment, sighting element 330 and mounting member 340 are preferably formed integrally as a single-piece construction.

Figure 7:
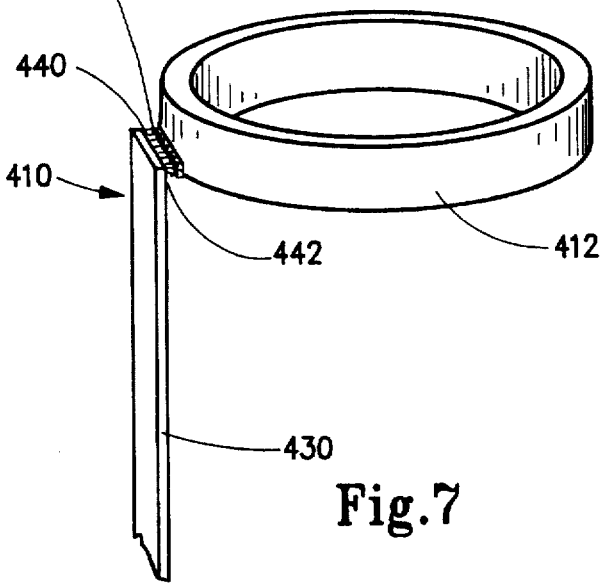
FIG. 7 is a perspective view of the golf ball sighting device according to the fourth exemplary embodiment of the present invention.

A fourth exemplary embodiment of the present invention is shown in FIG. 7 where golf ball sighting device 410 is comprised of mounting member 440 which is attached to sighting element 430. Mounting member 440 is constructed as a piece of VELCRO® material similar to mounting member 340 in FIG. 6. Here, however, mounting member 440 has a plurality of hooks 442 for releasably securing mounting member 440 to surface 446 of headband 412. In this fourth exemplary embodiment, mounting member 440 and sighting element 430 are located in common planes along sighting device 410 by virtue of the positioning of headband 412 when worn by golfer 16.

Figure 8:
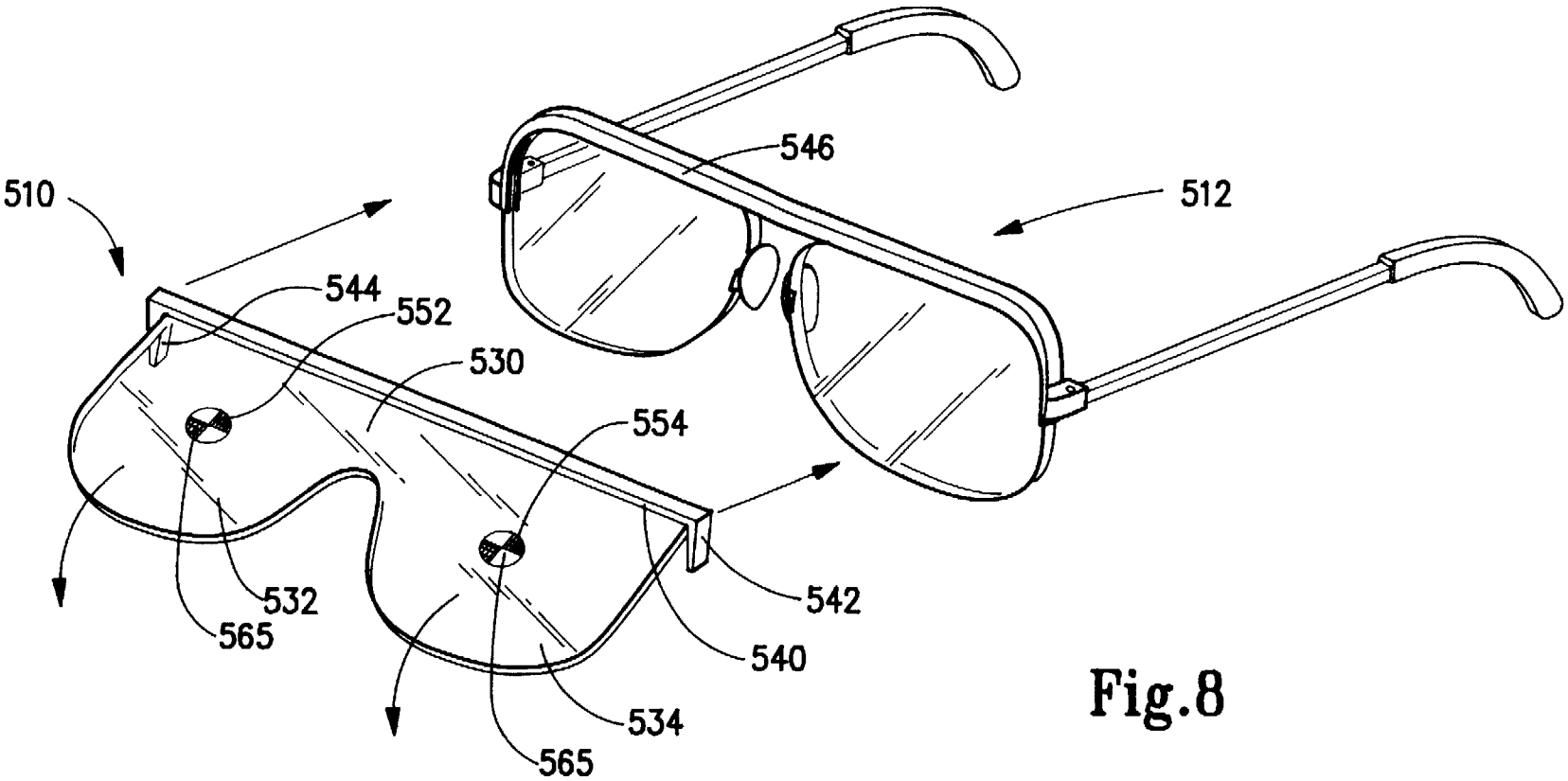
FIG. 8 is a perspective view of the golf ball sighting device according to the fifth exemplary embodiment of the present invention.

A fifth exemplary embodiment of the present invention is shown in FIG. 8. Here, golf ball sighting device 510 is adapted to attach to an item in the form of eyeglasses 512 worn by golfer 16. The golf ball sighting device 510 includes a sighting element 530 and a mounting member 540 connected thereto. The golf ball sighting device 510 is adapted to pivotally attach to the upper surface 546 of eyeglasses 512 by way of downwardly depending arms 542 and 544 located on opposite ends of mounting member 540. In this embodiment, the sighting element 530 is constructed as a pair of lens covers 532 and 534, with each lens cover having apertures 552 and 554 formed therein which is sized and configured to allow golfer 16 to view golf ball 20 therethrough when sighting device 510 is mounted onto eyeglasses 512. Viewing apertures 552 and 554 may be formed as etches within the surface of sighting element 530, or, alternatively, they may be formed as apertures extending through sighting element 530. Cross hairs 565 may also be provided. The embodiment of FIG. 8 also incorporates a pivoting feature which enables golfer 16 to pivot sighting element 530, once it is mounted on eyeglasses 512, to a location whereby viewing portions 552 and 554 are no longer along the line of sight between the golfer eyes 18 and golf ball 20.

From the foregoing it may be appreciated that the methodology according to the present invention broadly comprises a first step of providing a golf ball sighting device which includes a sighting element having a viewing portion formed therethrough and a mounting element connected to the sighting element. The method next includes the step of interposing the sighting element at a location on a line of sight between the golfer's eyes and the golf ball when the golfer is in a position to execute a golf swing, so that the golfer is permitted to have both a confined view of the golf ball and an unrestricted view of surrounding areas.

This methodology is best appreciated with reference again to FIGS. 1–3 wherein golf ball sighting device 10 is provided which includes sighting element 30 and mounting element 40 attached thereto. A viewing portion 52 in the form of an aperture is formed within the sighting element and sized and adapted to allow a golf ball 20 to be viewed therethrough. Sighting element 10 is then mounted to the brim 12 of hat 14 in such a way that the sighting element is interposed at a location on the line of sight "X" between the golfer's eyes 18 and the golf ball 20 when golfer 16 is in a position to execute the golf swing.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

I claim:

1. A golf ball sighting device for use as a teaching aid by encouraging a golfer to keep his/her head stationary while executing a golf swing, comprising:

(a) a sighting element having a viewing portion thereof which is sized and configured to allow a golf ball to be viewed therethrough; and (b) a mounting member disposed on said sighting element and adapted to interconnect said sighting element to an item worn by the golfer so that said sighting element is interposed on a line of sight between the golfer and the golf ball at a location which allows the golf ball to be viewed by the golfer through the viewing portion when the golfer is in a position to execute the swing, said sighting element sized such that the golfer is permitted to have both a confined view of primarily the golf ball during execution of the golf swing and an unrestricted view of surrounding areas.

2. A golf ball sighting device according to claim 1 wherein said viewing portion is sized and configured to enable the golf ball to be viewed therethrough in its entirety when the golfer is in a position to execute the swing.

3. A golf ball sighting device according to claim 1 wherein said viewing portion is formed as a circular opening.

4. A golf ball sighting device according to claim 3 wherein said circular opening has a diameter of between 0.44 cm (11/64 inches) and 0.95 cm (24/64 inches) inclusively.

5. A golf ball sighting device according to claim 1 wherein said viewing portion is formed as a rectangular opening.

6. A golf ball sighting device according to claim 5 wherein said rectangular opening is a square having an area of at least 0.40 $cm^2$ (1/16 $inches^2$).

7. A golf ball sighting device according to claim 1 wherein said mounting member is formed as clip structure having a pair of jaws defining a channel therebetween for clamping said item.

8. A golf ball sighting device according to claim 1 wherein said sighting element and said mounting member are formed integrally as a single-piece construction.

9. A golf ball sighting device according to claim 1 wherein said item is selected from a group consisting of a hat, a headband, a visor and eyeglasses.

10. A golf ball sighting device according to claim 1 wherein said mounting member is operative to pivotally attach said sighting element to said item so that said sighting element may be pivoted to an orientation out of said line of sight.

11. A golf ball sighting device for use as a teaching aid by encouraging a golfer to keep his/her head stationary while executing a golf swing, comprising:

(a) a sighting element formed as a longitudinal strip of material having a plurality of spaced-apart apertures formed therein to define a plurality of viewing portions through which said golfer may view the golf ball; and (b) a mounting member disposed on said sighting element and adapted to interconnect said sighting element to an item worn by the golfer so that said sighting element is interposed on a line of sight between the golfer and the golf ball at a location which allows the golf ball to be viewed by the golfer through a selected one of said viewing portions when the golfer is in a position to execute the swing, thereby causing the golfer to have a confined view of the golf ball while executing the golf swing.

12. A golf ball sighting device according to claim 11 wherein said apertures are sized to permit the golf ball to be viewed in its entirety through said apertures and wherein said sighting element is substantially opaque apart from said apertures.

13. A golf ball sighting device according to claim 12 wherein said apertures are equally sized and are spaced equidistantly from one another along said longitudinal strip of material.

14. A golf ball sighting device for use as a teaching aid by encouraging a golfer to keep his/her head stationary while executing a golf swing, comprising:

(a) a sighting element having a viewing portion thereof which is sized and configured to allow a golf ball to be viewed therethrough, said viewing portion configured as two parallel slits laterally juxtaposed on said sighting element and separated by a distance of about 0.6 and 0.7 cm (¼ inches); and (b) a mounting member disposed on said sighting element and adapted to interconnect said sighting element to an item worn by the golfer so that said sighting element is interposed on a line of sight between the golfer and the golf ball at a location which allows the golf ball to be viewed by the golfer through the viewing portion when the golfer is in a position to execute the swing, thereby causing the golfer to have a confined view of the golf ball while executing the golf swing.

15. A golf ball sighting device for use as a teaching aid by encouraging a golfer to keep his/her head stationary while executing a golf swing, comprising:

(a) a sighting element having a viewing portion thereof which is sized and configured to allow a golf ball to be viewed therethrough, said viewing portion having a dimension which extends a majority of a transverse distance between side edges of said sighting element; and (b) a clip structure disposed on said sighting element and operative to receive and retain an item worn by the golfer so that said sighting element is interposed on a line of sight between the golfer and the golf ball at a location which allows the golf ball to be viewed by the golfer through the viewing portion when the golfer is in a position to execute the swing, wherein the sighting element is sized such that the golfer is permitted to have a confined view of primarily the golf ball while executing the golf swing.

16. A golf ball sighting device according to claim 15 wherein said clip structure includes first and second jaws oriented in an opposed relationship to define a clip channel therebetween with said clip channel sized and adapted to receive said item therein.

17. A golf ball sighting device according to claim 16 wherein said first and second jaws are symmetrically configured.

18. A golf ball sighting device according to claim 16 wherein said first and second jaws are resiliently biased into a closed position.

19. An article of apparel adapted to be worn by a golfer, said article of apparel for use as a teaching aid by encouraging the golfer to keep his/her head stationary while executing a golf swing, comprising:

(a) headwear including a brim;

(b) a sighting element having an aperture formed therein, said aperture sized and configured so that a golf ball may be viewed therethrough; and (c) a mounting member connected to said sighting element, said mounting member for interconnecting said sighting element to said brim so that said sighting element depends downwardly from said mounting member and is interposed on a line of sight between the golfer and the golf ball at a location which allows the golf ball to be seen by the golfer when the golfer is in a position to execute the swing, said viewing portion having a dimension which is oriented transversely to said line of sight and which extends a majority of a separation distance between longitudinal side edges of sighting element, said sighting element sized such that the golfer is permitted to have a confined view of primarily the golf ball while executing the golf swing.

20. An article of apparel according to claim 19 wherein said mounting member is a clip structure having a channel operative to receive the brim of said headwear.

21. An article of apparel according to claim 19 wherein said mounting member includes a piece of VELCRO® material for removably attaching said sighting element to the brim of said headwear.

22. An article of apparel according to claim 19 wherein said sighting element is a longitudinal strip of material having a plurality of apertures formed therethrough, said golfer thereby able to selectively view the golf ball through a selected one of said apertures.

23. A method of improving a golfer's game by encouraging the golfer to keep his/her head stationary while executing a golf swing, said method comprising:

(a) providing a golf ball sighting device, said sighting device including a sighting element which has an aperture formed therethrough and a mounting element connected to said sighting element, said aperture being sized and configured to permit a golf ball to be seen therethrough; and (b) interposing said sighting element at a location on a line of sight between the golfer and the golf ball when the golfer is in a position to execute the golf swing, thereby to permit the golfer to have both a confined view of primarily the golf ball and an unrestricted view of surrounding areas.

24. The method of claim 23 wherein the step of interposing the sighting element is accomplished by attaching the mounting member to an item worn by the golfer.

* * * * *